United States Patent [19]

Chung

[11] Patent Number: 4,745,980

[45] Date of Patent: May 24, 1988

[54] AUTO-HAMMER DRIVER

[76] Inventor: Te-Shun Chung, No. 230-16, Lin Lo Road, Lin Lo Hsiang, Pingtung Hsien, Taiwan

[21] Appl. No.: 934,680

[22] Filed: Nov. 25, 1986

[30] Foreign Application Priority Data

Mar. 30, 1985 [TW] Taiwan ..... 74202286

[51] Int. Cl.[4] ..... B25D 15/00

[52] U.S. Cl. ..... 173/93.7; 173/111

[58] Field of Search ..... 173/93, 93.7, 104, 109–111, 173/90; 81/52.3, 27; 74/89.15, 127, 128

[56] References Cited

U.S. PATENT DOCUMENTS

| | | | |
|---|---|---|---|
| 2,398,231 | 4/1946 | Kott | 173/111 |
| 2,478,894 | 8/1949 | Carlsten | 173/111 |
| 3,789,896 | 2/1974 | Cooke-Yarborough | 173/93 |
| 4,561,507 | 12/1985 | Liou | 173/93 |

*Primary Examiner*—E. R. Kazenske
*Assistant Examiner*—James L. Wolfe
*Attorney, Agent, or Firm*—Lackenbach Siegel Marzullo & Aronson

[57] ABSTRACT

An improved hammer driver includes a body with an outward flange on a lower portion thereof, a removable socket member adapted to driving a nut or bolt, a rotary member interconnecting the body and the socket member and including a radially extending rotary arm for being actuated to rotate the socket member, an impact member slidably sleeved on the body above the outward flange for sliding axially on the body to hammer against the outward flange, and a transmission device for rotating the rotary member and hence socket member when the outward flange of the body is hammered by the impact member.

1 Claim, 2 Drawing Sheets

AUTO-HAMMER DRIVER

BACKGROUND OF THE INVENTION

The invention relates to a hammer driver, particularly to an auto-hammer driver with a impact member slidably mounted on the hammer driver for hammering.

Generally, a bolt or nut retained on an article must be loosened by means of a hammer driver and a hammer when it is rusty or when it is fastened very tightly. In use, the hammer driver and the hammer are always held, respectively, in the two hands of a user. Additionally, the hammer must be struck to hammmer flush with the top end of the hammer driver. When they are operated overhead, this is dangerous. In addition to the inconvenience in use, such tools are awkward to carry together.

SUMMARY OF THE INVENTION

It is therefore an object of the invention to provide an auto-hammer driver with a slidable impact member whereby a hammer preferably is unnecessary in use so as to overcome the above-mentioned inconvenience in carrying both for use.

Another object of the invention is to provide an auto-hammer driver with a transmission device whereby the driving head of the hammer driver will be rotated during hammering.

According to the invention, the hammer driver includes a body with an outward flange provided on the working portion thereof; a socket member mounted removably on the work side of the working end of the body; a rotary member, interconnecting the socket member and the body, including a driving head for mounting removably the socket member thereon, and a radial ratcheted arm projecting from the impact end of the driving head; a hollow impact member axially slidably sleeved on the body at the impact side of the outward flange for hammering against the outward flange; and transmission means for rotating the rotary member and hence the socket member when the outward flange of the rotary member is hammered by the impact member.

DETAILED DESCRIPTION OF THE PREFERRED EMBODIMENT

Figure 1:
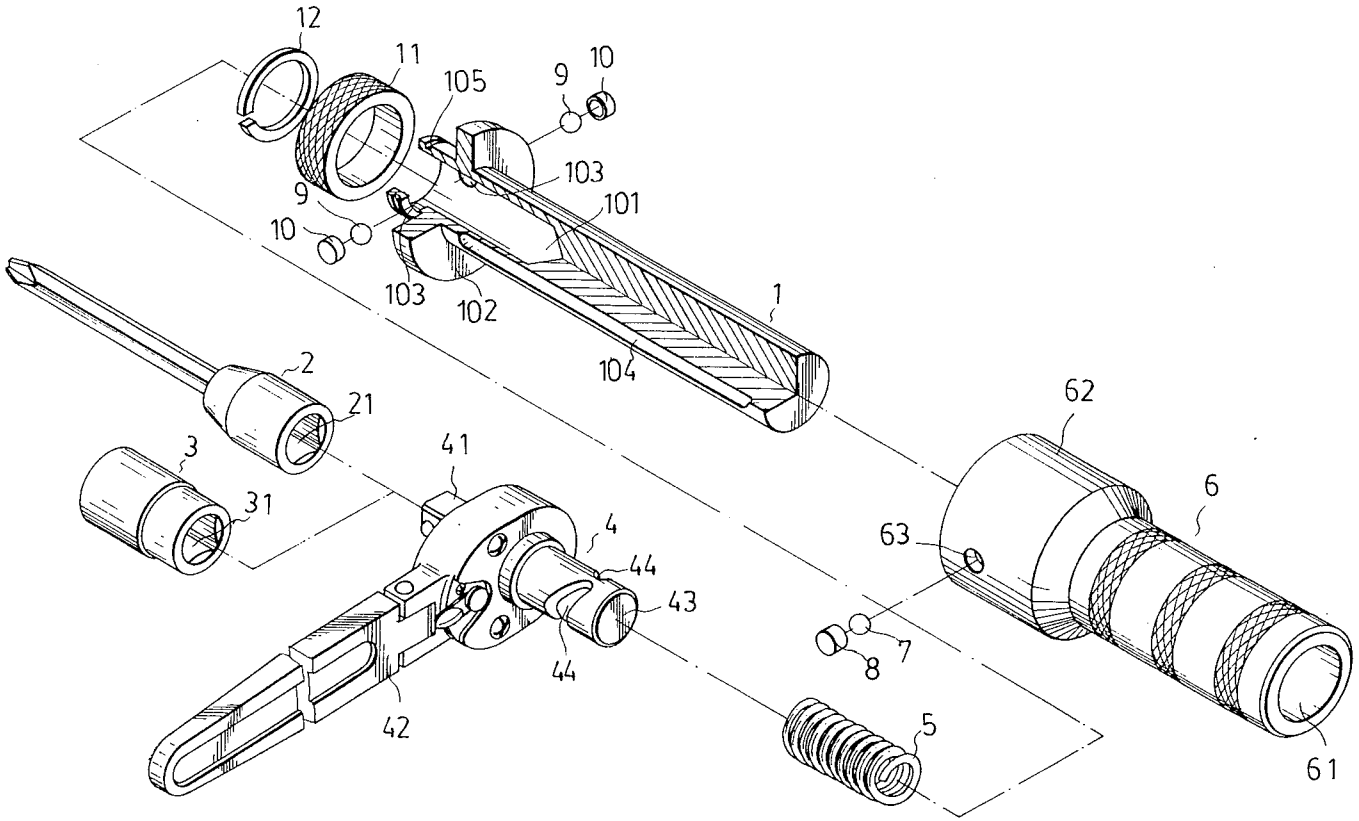
FIG. 1 is an exploded view of an auto-hammer driver according to the invention.

Referring to drawings, an auto-hammer driver according to the invention includes a cylindrical body 1; a socket member, being either of a screw driver socket member 2 or wrench socket member 3; a rotary member 4; a compression spring 5; a hollow impact member 6; a guide ball 7; a set screw 8; a pair of aligned push balls 9; a pair of aligned cylindrical plugs 10; a blocking ring member 11; and a C-shaped retaining ring 12.

The cylindrical body 1 includes a hollow work side portion with an axial inner cavity 101 in the working end surface thereof; an outward flange 102 provided on the hollow work side portion; a pair of opposed radial circular holes 103 provided through the hollow lower portion below the outward flange 102; an elongate, straight axial guide groove 104 provided in the outer surface of the body 1 above the outward flange 102; and an annular groove 105 provided in the outer surface of the body 1 on the work side of the circular holes 103.

The socket members 2 and 3 have respectively a rectangular socket 21 and 31.

The rotary member 4 includes a cubic driving head 41 for insertion into the rectangular socket 21 or 31 of the socket member 2 or 3, a radial ratcheted arm 42 connected to the upper end of the cubic driving head 41 and projecting radially from the rotary member 4, and a cylindrical upper portion 43 connected to the upper end of the ratcheted arm 42 and having a pair of opposed V-shaped slots 44 provided in the opposite sides of the outer surface of cylindrical upper portion 43.

The compression spring 5 abuts on the impact end of the cylindrical impact side portion 43 of the rotary member 4 and is received in the inner cavity 101 of the body 1 for biasing the rotary member 4 away from the body 1.

The impact member 6 includes a bore 61 as a sleeve on the cylindrical body 1 above the outward flange 102, an enlarged lower portion 62, and a radial tap hole 63 provided through a side wall of the enlarged lower portion 62.

The guide ball 7 is restricted by the set screw 8 to move within the tap hole 63 of the impact member 6 and the guide groove 104 of the body 1 for sliding back and forth synchronously with the impact member 6 along the guide groove 104.

Figure 2:
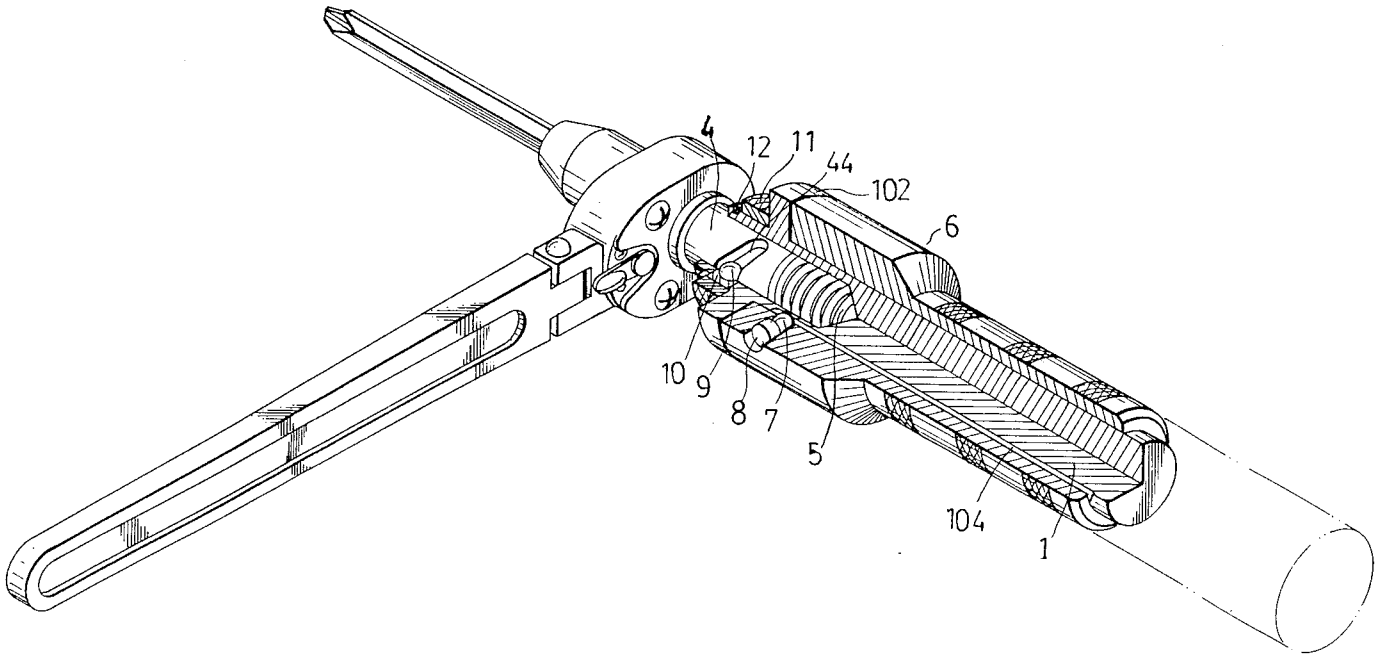
FIG. 2 is an assembled perspective view of the auto-hammer driver of FIG. 1, part in section.

The blocking ring member 11 which is prevented from downward movement by the C-shaped retaining ring 12 is adapted to block the plugs 10 each of which have a curved concavity (see FIG. 2) at the inner end thereof for restricting the push balls 9 to move synchronously with the body 1 and to roll back and forth in the V-shaped slots 44. Thus, when the outward flange 102 is hammered by the impact member 6 to move it down and back, the push balls 9 are confined between the V-shaped slots 44 of the rotary member 4 and the curved concavities of the plugs 10 to move synchronously with the body 1 to push the rotary member 4 down and back through the V-shaped slots 44. It should be understood that the V-shaped slots 44 will move back and forth diagonally relative to the push balls 9 because the push balls 9 push the oblique sides of the V-shaped slots 44 of the rotary member 4, that is, the rotary member 4 and hence the socket member 2 or 3 will rotate when the outward flange 102 is hammered by the impact member 6.

In assembly, the compression spring 5 is initially inserted into the inner cavity 101 of the body 1, then, the cylindrical upper portion 44 of the rotary member 4 is also inserted into the inner cavity 101 of the body 1. Subsequently, the body 1 is rotated to permit the circular holes 103 of the body 1 to register with the V-shaped slots 44 of the rotary member 4 so that the push balls 9 and the plugs 10 can in turn be inserted into the circular holes 103 of the body 1. After the insertion of the push balls 9 and the plugs 10 into the circular holes 103 of the body 1, the blocking ring member 11 is sleeved on the body 1 around the circular holes 103, and the C-shaped retaining ring 12 is then sleeved on the body 1 and in the annular groove 105. Finally, the impact member 6 is sleeved on the body 1 above the outward flange 102 while the tap hole 63 registers with the guide groove 104 of the body 1 so that the guide ball 7 can be put into the tap hole 63, to be restricted by the set screw 8 subsequently bolted in the tap hole 63, to roll along the guide groove 104 of the body 1. Additionally, the socket member 2 or 3 can be sleeved on the cubic driving head 41 of the rotary member 4.

In use, as described above, when the outward flange 102 of the body 1 is hammered by rapid, straight sliding movements down and back of the impact member 6, the push balls 9 will move down and back synchronously with the body 1 to push the rotary member 4 through the V-shaped slots 44 to cause the rotary member 4 and hence the socket member 2 or 3 to rotate. This rotation of the socket member 2 or 3 during hammering causes easy loosening of the bolt and the nut to be driven.

With the invention thus explained, it is apparent that various modifications and variations can be made without departing from the scope of the invention. It is therefore intended that the invention be limited as indicated in the appended claims.

I claim:

1. An auto-hammer driver for loosening a bolt or nut comprising:

(a) a cylindrical body having a work end, an impact end, a work side portion and a work end surface with an outward flange provided on the work side portion thereof, said cylindrical body having a hollow work side portion with an inner cavity in the work end surface thereof and a pair of opposed radial circular holes provided through said hollow work side end portion of said body, and an annular groove provided in the outer surface of said cylindrical body on the work side of said circular holes;

(b) a rotary member having a work end, an impact end, and a central portion thereof comprising a driving head at the work end portion thereof, a ratcheted radial arm projecting from the central portion thereof, a cylindrical axial impact-side portion of said rotary member having a diameter slightly less than the inside diameter of the inner cavity of the cylindrical body for insertion into said inner cavity of said cylindrical body, said cylindrical axial impact-side portion of the rotary member further provided with a pair of opposing V-shaped slots on its surface, a pair of aligned push balls each restrictedly received in one of said V-shaped slots, a compression spring disposed within the inner cavity of the cylindrical body and abutting the impact end of the cylindrical axial impact-side portion for biasing the rotary member away from the cylindrical body, a pair of aligned cylindrical plugs with inner and outer ends, each received in one of the radial circular holes of the cylindrical body and including a curved concavity at the inner end thereof for restricting one of said push balls to move synchronously back and forth with said cylindrical body and to roll within said V-shaped slots;

(c) a socket member removably mounted on the work end of the rotary member for driving said bolt or nut;

(d) a blocking ring member removably sleeved on said cylindrical body at the work end around the circular holes for confining the cylindrical plugs within said circular holes;

(e) a C-shaped retaining ring having a notch for removable sleeving on the cylindrical body in said annular groove on the work end of the blocking ring;

(f) a tubular hollow impact member, axially slidably sleeved on the impact end of the cylindrical body for hammering against the outward flange of said body; and (g) means for guiding said impact member to slide axially on the cylindrical body in straight line motion;

whereby when the impact member is hammered on the outward flange of the cylindrical body, that body and the push balls move back and forth in the V-shaped slots of the rotary member thereby driving the socket member to rotate.

* * * * *